United States Patent [19]

Kunz

[11] 4,414,963

[45] Nov. 15, 1983

[54] MASSAGE DEVICES

[75] Inventor: Raymond W. Kunz, Monroe, Conn.

[73] Assignee: Clairol Incorporated, New York, N.Y.

[21] Appl. No.: 138,488

[22] Filed: Apr. 9, 1980

Related U.S. Application Data

[63] Continuation-in-part of Ser. No. 41,277, May 21, 1979, abandoned.

[51] Int. Cl.[3] ..... A61H 7/00

[52] U.S. Cl. ..... 128/60

[58] Field of Search ..... 128/25 R, 25 B, 33, 128/45, 46, 48, 49, 56, 60, 64, 67; 15/28

[56] References Cited

U.S. PATENT DOCUMENTS

| | | | |
|---|---|---|---|
| 728,003 | 5/1903 | Pfanschmidt et al. | 15/28 |
| 737,465 | 8/1903 | Pfanschmidt et al. | 128/48 |
| 778,771 | 12/1904 | Adams et al. | 128/49 |
| 782,663 | 2/1905 | Johansen | 128/45 |
| 855,342 | 5/1907 | Richmond | 128/46 |
| 856,378 | 6/1907 | Ward et al. | 128/48 |
| 912,016 | 2/1909 | Miller | 128/45 |
| 968,209 | 8/1910 | Trautman | 128/46 |
| 978,031 | 12/1910 | Kent | 128/46 |
| 1,396,630 | 11/1921 | Higbee | 15/28 |
| 1,577,751 | 3/1926 | Paschall | 128/51 |
| 1,592,144 | 7/1926 | Macaura | 128/24.5 |
| 1,844,247 | 2/1932 | Freemon | 128/242 |
| 2,036,677 | 4/1936 | Bergman | 128/48 |
| 2,064,418 | 12/1936 | Derringer | 128/52 |
| 2,078,025 | 4/1937 | Samuels | 128/55 |
| 2,144,343 | 1/1939 | Newnham | 128/41 |
| 2,206,902 | 7/1940 | Kost | 128/25 |
| 2,219,086 | 10/1940 | Broberg | 128/57 |
| 2,265,729 | 12/1941 | Hall | 128/52 |
| 2,430,414 | 11/1947 | Stern | 128/41 |
| 2,521,874 | 9/1950 | Runstedler | 128/49 |
| 2,604,091 | 7/1952 | Hansen | 128/41 |
| 2,625,152 | 1/1953 | Frohring | 128/2 |
| 2,637,319 | 5/1953 | Bruene | 128/49 |
| 2,808,602 | 10/1957 | Gregoire | 128/56 X |
| 2,840,071 | 6/1958 | McNair | 128/33 |
| 2,907,323 | 10/1959 | Ritter | 128/46 |
| 2,914,065 | 11/1959 | Cory | 128/45 |
| 2,920,618 | 1/1960 | Oster, Jr. | 128/33 |
| 2,988,084 | 6/1961 | Douglas | 128/41 |
| 3,043,294 | 7/1962 | Neff | 128/33 |
| 3,155,854 | 11/1964 | Stam | 310/29 |
| 3,207,152 | 9/1965 | Thornton | 128/33 |
| 3,273,093 | 9/1966 | Hayden | 335/203 |
| 3,323,517 | 6/1967 | Keller | 128/24.1 |
| 3,346,748 | 10/1967 | McNair | 310/16 |
| 3,366,105 | 1/1968 | Sadowski et al. | 128/24.1 |
| 3,374,784 | 3/1968 | Brent et al. | 128/61 |
| 3,467,080 | 9/1969 | McNair | 128/24.2 |
| 3,489,138 | 1/1970 | Lifschitz | 128/24.2 |
| 3,678,924 | 7/1972 | Fujimoto | 128/46 |
| 3,683,896 | 8/1972 | Peplin | 128/24.2 |
| 3,762,402 | 10/1973 | Abramovitz | 128/33 |
| 3,768,461 | 10/1973 | Taylor | 128/24.2 |
| 3,802,420 | 4/1974 | Moffat | 128/56 |
| 3,993,052 | 11/1976 | Miyahara | 128/46 |
| 4,061,137 | 12/1977 | Sandt | 128/33 |
| 4,105,024 | 8/1978 | Raffel | 128/33 |

FOREIGN PATENT DOCUMENTS

| | | |
|---|---|---|
| 402762 | 10/1909 | France . |
| 991261 | 10/1951 | France . |

*Primary Examiner*—Richard C. Pinkham
*Assistant Examiner*—Matthew Schneider
*Attorney, Agent, or Firm*—Isaac Jarkovsky; John J. Balser; Gerald S. Rosen

[57] ABSTRACT

There is disclosed massage mechanisms comprising one or more drivers having an angled socket on the end of each driver. The socket has a massage head rotatably engaged therewith by means of a post fixed essentially perpendicularly to the back of the massage head. The massage heads are generally conical in shape and can have collars around the periphery and downward from the base. The socket is angled to a degree which results in the axis of the head and the axis of the driver guide shaft intersecting at a point on the massage head or the driver. The diameter of the post on the massage head is less than the inside diameter of the socket. In operation the edges of the massage head rise and fall about 26°–30° in an undulating motion without imparting rotational motion while imparting a kneading, massaging action. The driver rotates at about 60–70 RPM which enables the massaging action to be synchronized to the heartbeat.

12 Claims, 14 Drawing Figures

MASSAGE DEVICES

This application is a continuation-in-part of U.S. patent application Ser. No. 41,277, filed May 21, 1979 and now abandoned.

BACKGROUND OF THE INVENTION

1. Field of The Invention

This invention relates to a massaging mechanism comprising a massage head rotatably inserted into a rotatable angled socket and to dry massage devices which utilize the massaging mechanism. When the angled socket is rotated, it causes the massage head to produce a non-rotating kneading, massaging action.

More particularly, this invention relates to a massage mechanism which comprises an easily replaced massage head having a non-rotating kneading, massaging action which is in general synchronization with the heartbeat of the massagee. This synchronization results in a maximization of the blood circulation to the muscles being massaged, thus aiding in the support of metabolic activity and increasing the tone and suppleness of the treated muscles.

2. Description Of The Prior Art

There are a variety of dry massage devices which utilize angled massage heads, however, none of these devices have massage heads which can be removed while the apparatus is in operation and none of these devices are synchronized to the heartbeat of the massagee.

Examples of those prior art devices which have non-rotating massage heads are:

Sandt, U.S. Pat. No. 4,061,137 which discloses a device that provides a vibrating action while utilizing flat massage heads with wobbling motions. This device is a complex mechanism which does not impose a lateral or chafing motion. The massage heads are non-rotatably attached to the drive means and can safely be removed only when the device is not operating.

Thornton, U.S. Pat. No. 3,207,152 discloses a massage couch having multiple inclined flat massage heads attached to a rotating shaft. The heads rotate but are covered by massage pads which do not rotate but have a wobbling motion. The wobble massage heads can be actuated at different speeds to more closely simulate the action of a pair of hands giving a Swedish massage.

Fujimoto, U.S. Pat. No. 3,678,924 discloses a device in which a flat circular plate is rotatably attached to an angled drive shaft by means of a bearing. When the shaft rotates, the plate does not, causing the plate to wobble. The shaft is actuated by a motor driven belt.

The prior art also includes massage devices which operate on eccentric shafts such as Richmond, U.S. Pat. No. 855,342; Miller, U.S. Pat. No. 912,016; Macaura, U.S. Pat. No. 1,592,144; and, Miyahara, U.S. Pat. No. 3,993,052.

Other prior art devices operate by means of vibration, examples are, Hall, U.S. Pat. No. 2,265,729 and Freemon, U.S. Pat. No. 1,844,247.

Some other prior art devices disclose a plurality of massaging heads which may be on angular shafts, such as, Paschall, U.S. Pat. No. 1,577,751; Ritter, U.S. Pat. No. 2,907,323; and, Brent, U.S. Pat. No. 3,374,784.

The prior art does not teach the concept of utilizing a non-rotating, easily removable massage head which is set rotatably into a socket which is fixedly attached to or is an integral part of a driver at an angle at which the axis of the driver can intersect the axis of the massage head at a point on the center of the top of the massage head or along the center post. In addition, the prior art does not teach utilizing a massage disc which has a non-rotating kneading action essentially in synchronization with the heartbeat.

OBJECTS OF THE INVENTION

It is an object of this invention to provide an improved massaging mechanism.

It is a further object of this invention to provide an improved massage mechanism wherein the massage head is rotatably set into a socket fixed at an angle on a driver.

It is still another object of this invention to provide an improved massage mechanism in a massage device wherein the massage head can be removed and replaced while the device is operating.

It is yet another object of this invention to provide an improved massage device suitable for use as a foot massager which utilizes a massage mechanism wherein the massage heads are rotatably set into sockets fixed at an angle on a driver.

It is an additional object of this invention to provide an improved massage device suitable for use as a hand-held body massager which utilizes a massage mechanism wherein the massage head is rotatably set into a socket fixed at an angle on a driver.

It is yet an additional object of this invention to provide an improved massage mechanism adaptable to a variety of massage devices.

SUMMARY OF THE INVENTION

This invention is directed to massage mechanisms comprising one or more drivers having an angled socket fixed on the end of each driver. The angled socket can also be integral with the driver. The socket has a massage head rotatably engaged therewith by means of a post fixed essentially perpendicularly to the back of the head. The massage heads are generally conical shaped discs. The socket is angled to a degree which results in the axis of the head and the axis of the driver intersecting at a point on the massage head or post which results in the desired massaging action with a minimum of excess shear or excess chafing. Preferably the intersection is at the apex of the cone for a hand-held body massager and on the post for a foot massager. As the socket rotates, it causes one edge of the massage head to rise while the other falls to give an undulating, kneading action. The edges of the conical shaped disc rise and fall through e.g. about a 20° to 30° angle. The driver is operatively connected to a power source which causes the driver to revolve the socket at a rate approximating the heartbeat, i.e., about 60 to 70 RPM. The massage head can be removed and replaced by another head with a different top shape or surface while the massage device with which it is associated is in operation. The massage mechanisms can be utilized in a variety of massage devices such as foot massagers and hand-held body massagers and can be used in vibrating massagers.

DETAILED DESCRIPTION OF THE INVENTION

Figure 1:
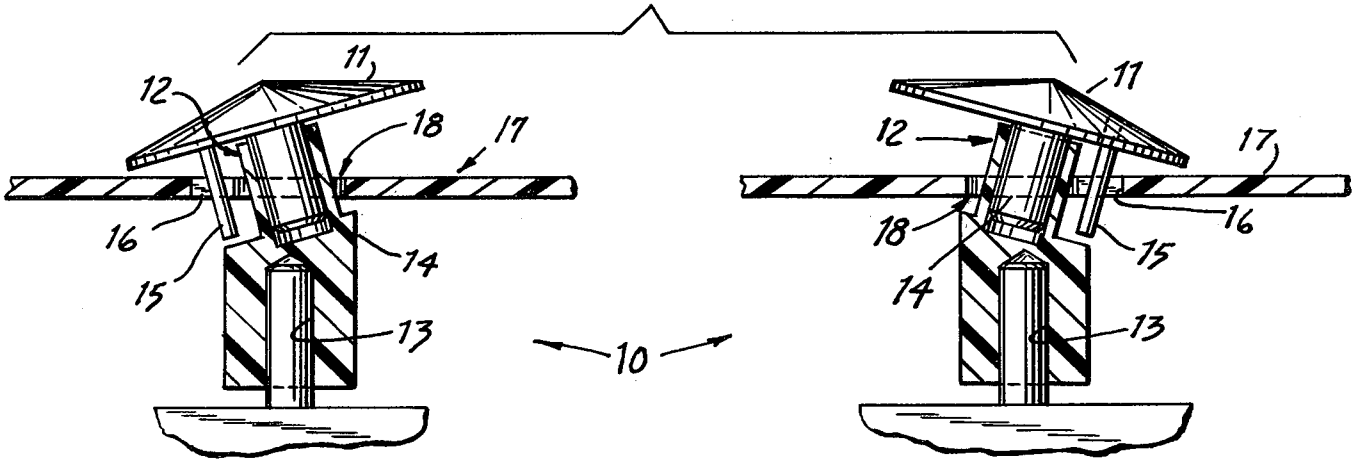
FIG. 1 shows two perspective views of a massage head and socket in accordance with this invention.

Referring to the drawings, there is shown in FIG. 1 the details of the structural relationship of a driver guide shaft 13, driver with socket hole 12 and massage head 11. The massage head 11 having a perpendicular center post 14 rotatably fits into the angled socket in the driver 12 which is fixedly attached to or integral with the driver guide shaft 13 and rotates with it. The head 11 is of a short conical shape and has extending downward from the base, a key 15 which fits into a slot 16 in the housing 17 shown in part adjacent the orifice 18. The diameter of the center post 14 is smaller than the inside diameter of the socket hole in the driver 12. The angle at which the axis of the driver guide shaft 13 intersects the axis of the massage head 11 is not critical to the operation of the massage head mechanism 10 since any angle will operate, however, it was found that an angle of about 10° to 15° depending on the desired shear to be applied to the massaged area gives optimum results. When the axes intersect at the apex of the cone, there is no lateral movement of the apex; this is most suitable for a hand-held body massager. As the point of intersection goes down the post at the base of the massage head, the apex of the cone has an increasing lateral movement. This is a preferred feature for a foot massager.

An advantageous feature of the device of this invention is that the massage heads can be easily changed to provide mild or vigorous massaging action.

FIGS. 2–9 depict a variety of surface configurations suitable for use as massage heads in this invention, some of which impart a vigorous massage action and others of which impart a mild action.

Figure 3:
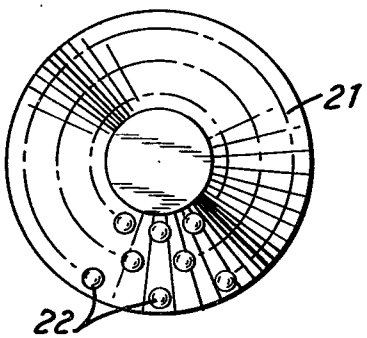
FIG. 3 is a top perspective view of the massage head in FIG. 2.
Figure 2:
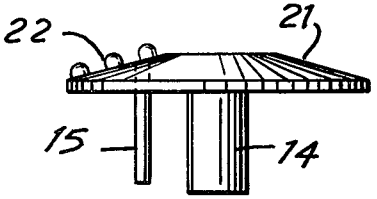
FIG. 2 is a side elevational view of a massage head with hemispherical tip pins on the top surface, which head can be placed in the socket of FIG. 1.

FIGS. 2 and 3 show a massage head 21 with hemispherical tip pins 22 which is suitable for use in this invention when a vigorous massage is desired. The massage head 61 shown in FIGS. 6 and 7 having radial bars 62 is also suitable for vigorous massage action.

Figure 8:
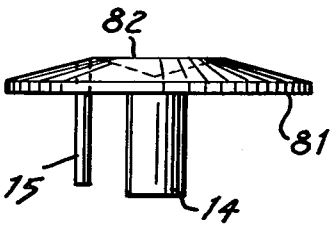
FIG. 8 is a side elevational view of a massage head with truncated cone shape having a depressed center on the top surface, which head can be placed in the socket of FIG. 1.
Figure 9:
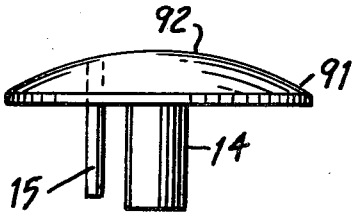
FIG. 9 is a side elevational view of a massage head of smooth rounded shape on the top surface, which head can be placed in the socket of FIG. 1.
Figure 6:
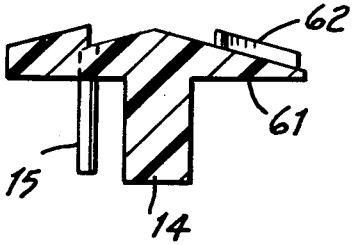
FIG. 6 is a side elevational view in cross section of a massage head with radial bars on the top surface, which head can be placed in the socket of FIG. 1.
Figure 7:
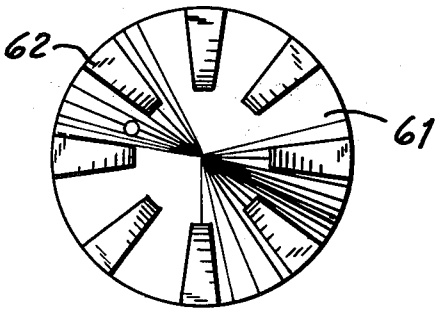
FIG. 7 is a top perspective view of the massage head in FIG. 6.
Figure 4:
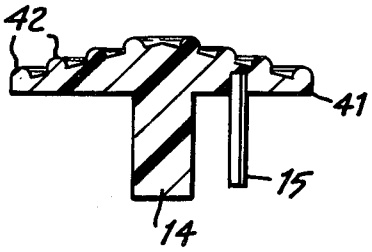
FIG. 4 is a side elevational view in cross section of a massage head with concentric rings on the top surface, which head can be placed in the socket of FIG. 1.
Figure 5:
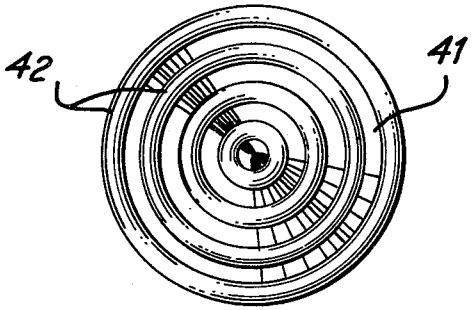
FIG. 5 is a top perspective view of the massage head in FIG. 4.

A less vigorous massage effect is obtained when using the massage head 41 in FIGS. 4 and 5, 81 in FIG. 8, and 91 in FIG. 9, having, respectively, concentric rings 42, a truncated cone with a depressed center 82 and a smooth rounded surface with the apex removed 92.

Figure 10:
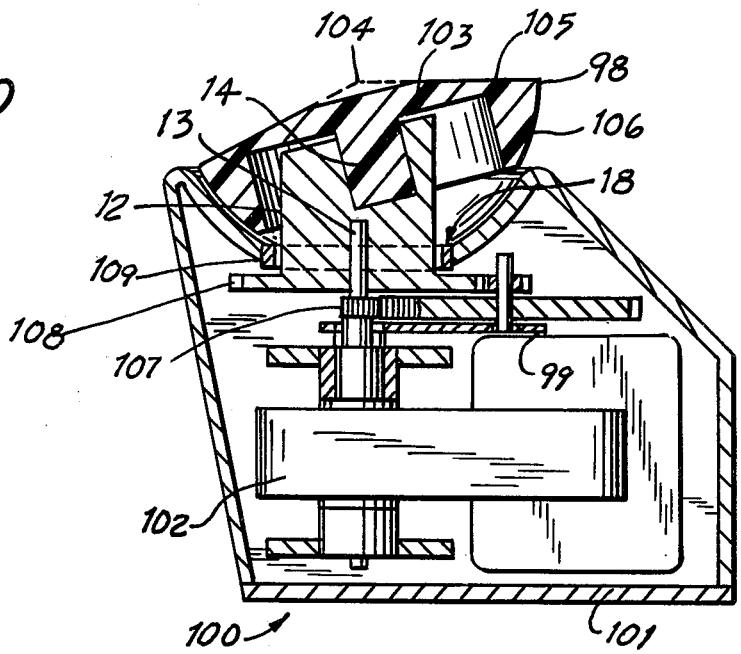
FIG. 10 is a side elevational view in cross-section of a hand-held massager with no housing details.

FIG. 10 shows a hand-held massager 100 comprised of a housing 101 with an electric motor 102 therein, said motor having a driver guide shaft 13 with a tilted driver with a socket hole 12 fixedly attached or integral therewith on the end thereof. The tilt of the socket hole in the driver 12 is at an angle which ensures that the massage head 103 therein imparts little or no lateral movement and chafing to the massaged portions of the body. The housing 101 is of a shape which makes it easy to hold in the hand. Generally, if the axis of the driver guide shaft 13 intersects the axis of the apex 104 of the cone on the top surface of the head 103, the optimum massaging action is obtained. The center post 14 of the head 103 fits rotatably in the socket hole of driver 12, as it has a diameter smaller than the inside diameter of the socket hole. The head 103 can be of a variety of shapes on its top surface 105. The head 103 depicted in FIG. 10 is of a short, smooth, conical shape with the apex 104 removed. This results in the massaging action being distributed over a wider area. The head preferably has a collar 106 which fits rotatably in the orifice 18 of the housing 101. When the motor 102 is turned on, it rotates the bottom gear 107, the idler gearset 99 and the top gear 108 which is fixed to the driver with the socket hole 12. This rotates the driver 12 at a rate approximating the heartbeat, i.e., about 60–70 RPM. As the driver with the socket hole 12 rotates, it causes in the edge 98 of the massage head 103 to rise and fall in an undulating motion through about 20° to 30°, depending on the angle of tilt which is one half the angle and edge 98 of the massage head 103 rises and falls. The device 100 is designed so that when the massage head 103 is pressed against the body, the pressure prevents the massage head 103 from rotating substantially and assures that the desired non-rotating kneading, massaging action takes place. The massage head 103 can be removed while the device 100 is turned on or it can be removed while it is turned off. This enables the operator to change with facility the massage head 103 to suit personal preference and use, for example, the massage heads depicted in FIGS. 2–9. Another means to make sure that the massage head does not rotate with the driver with the socket hole 12 is to provide a key pin as depicted in FIGS. 1, 2, 4, 6, 8 and 9, and a keyhole as depicted in FIG. 1. In order to assist in preventing the top gear 108 from lifting out through the orifice 18, a ring 109 is inserted in the orifice 18.

The device of this invention can have multiple massage heads driven by a power source which causes each to have a non-rotating kneading action. For example, a body massage couch or chair can be constructed using the massage mechanism of this invention. The massage mechanism of this invention is eminently suitable for use in a foot massage device. Such devices can be made with, e.g. as many as eight massage heads arranged in the housing so that for each foot one head massages the toes, one head massages the ball of the foot, one head massages the arch, and one head massages the heel; or a simple foot massage device can be constructed with one massage head for massaging one foot at a time or two massage heads so both feet can be massaged at the same time if desired. In such cases, one moves the foot over the massage head to get the desired effect.

Foot massagers are depicted in FIGS. 11, 12, 13 and 14 in which like numbers denote like parts.

Figure 14:
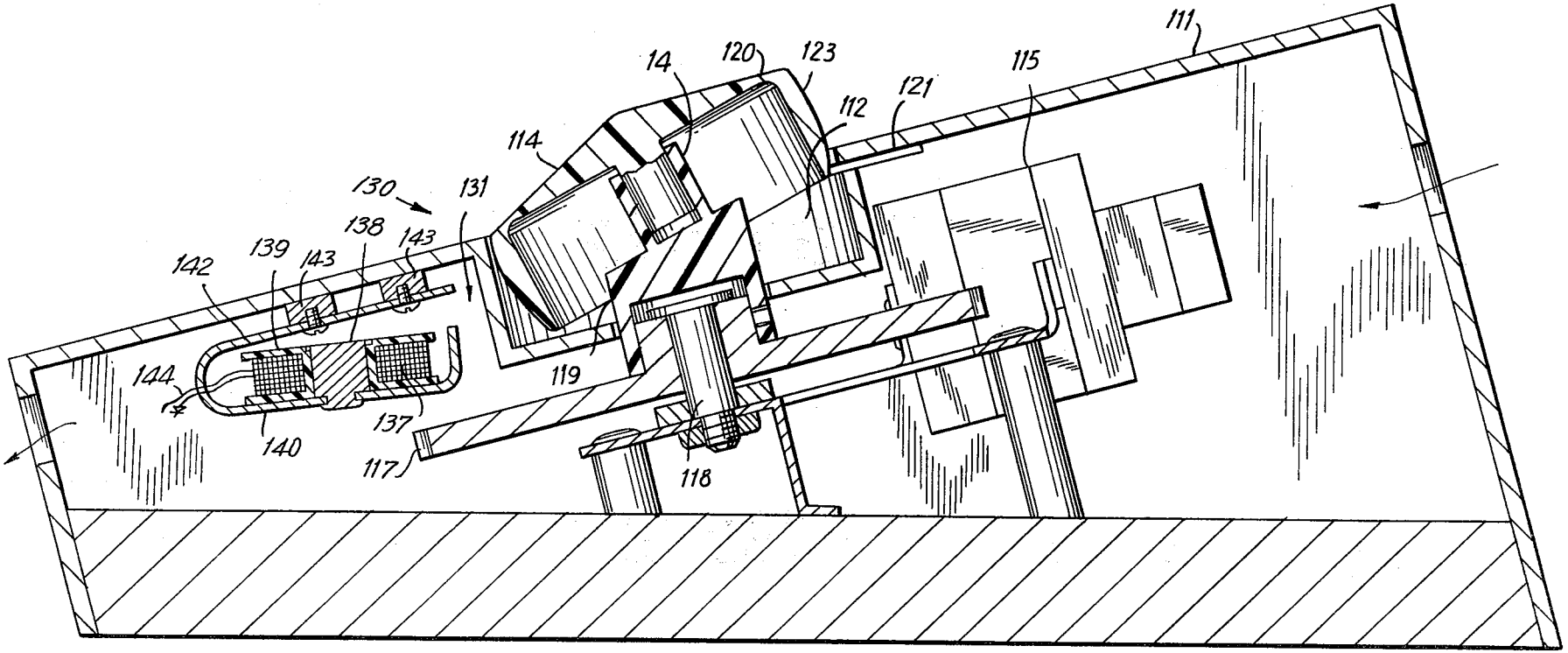
FIG. 14 is a side elevational view in cross-section of a single head foot massager with a vibrator in the housing.

A single head foot massager 130 of this invention is depicted in FIG. 14 showing the embodiment with a vibrator 131.

Figure 13:
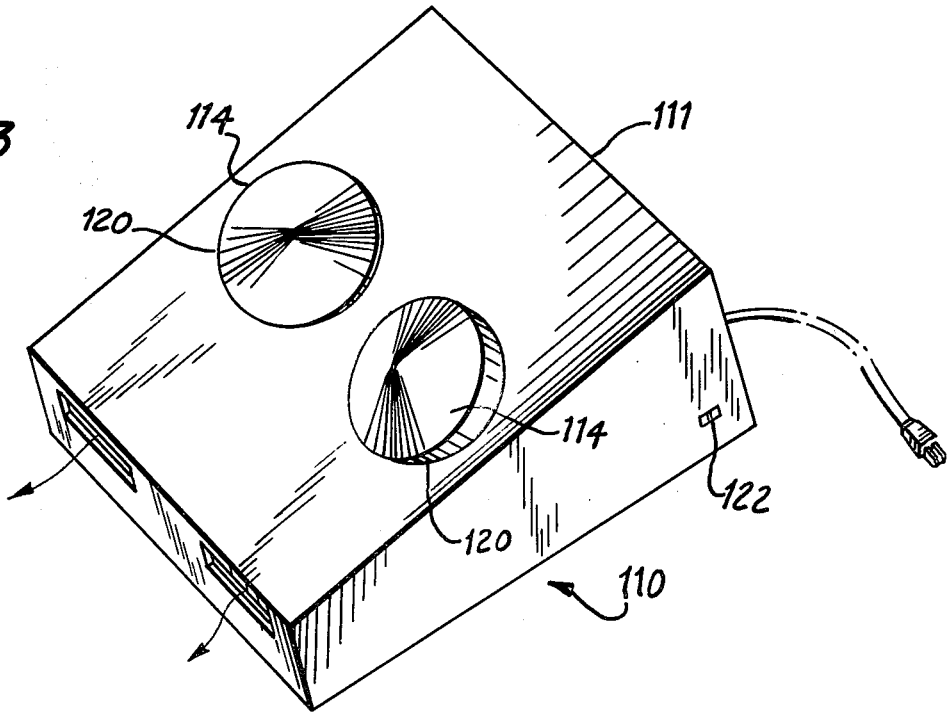
FIG. 13 is a top perspective view of a dual head foot massager and housing in accordance with this invention.
Figure 11:
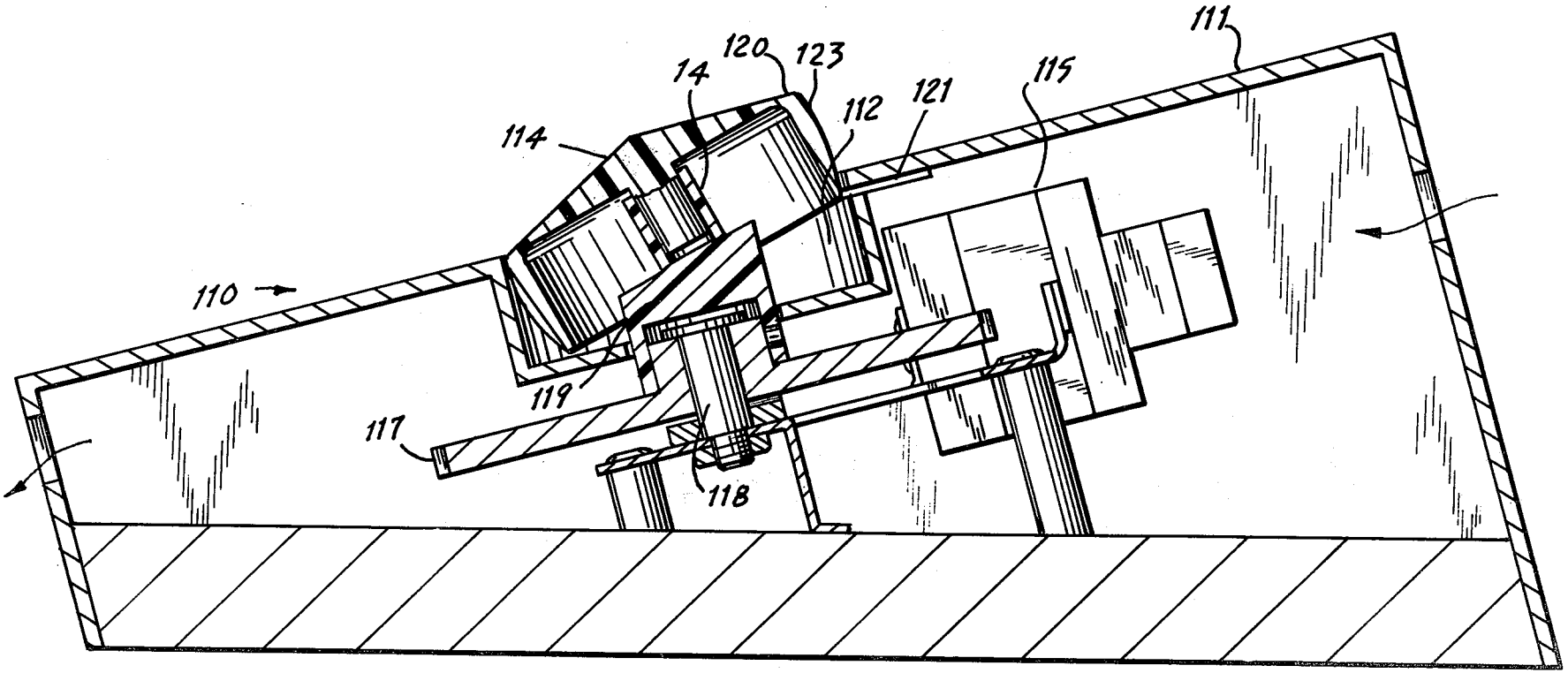
FIG. 11 is a side elevational view in cross-section of a dual head foot massager in a housing.
Figure 12:
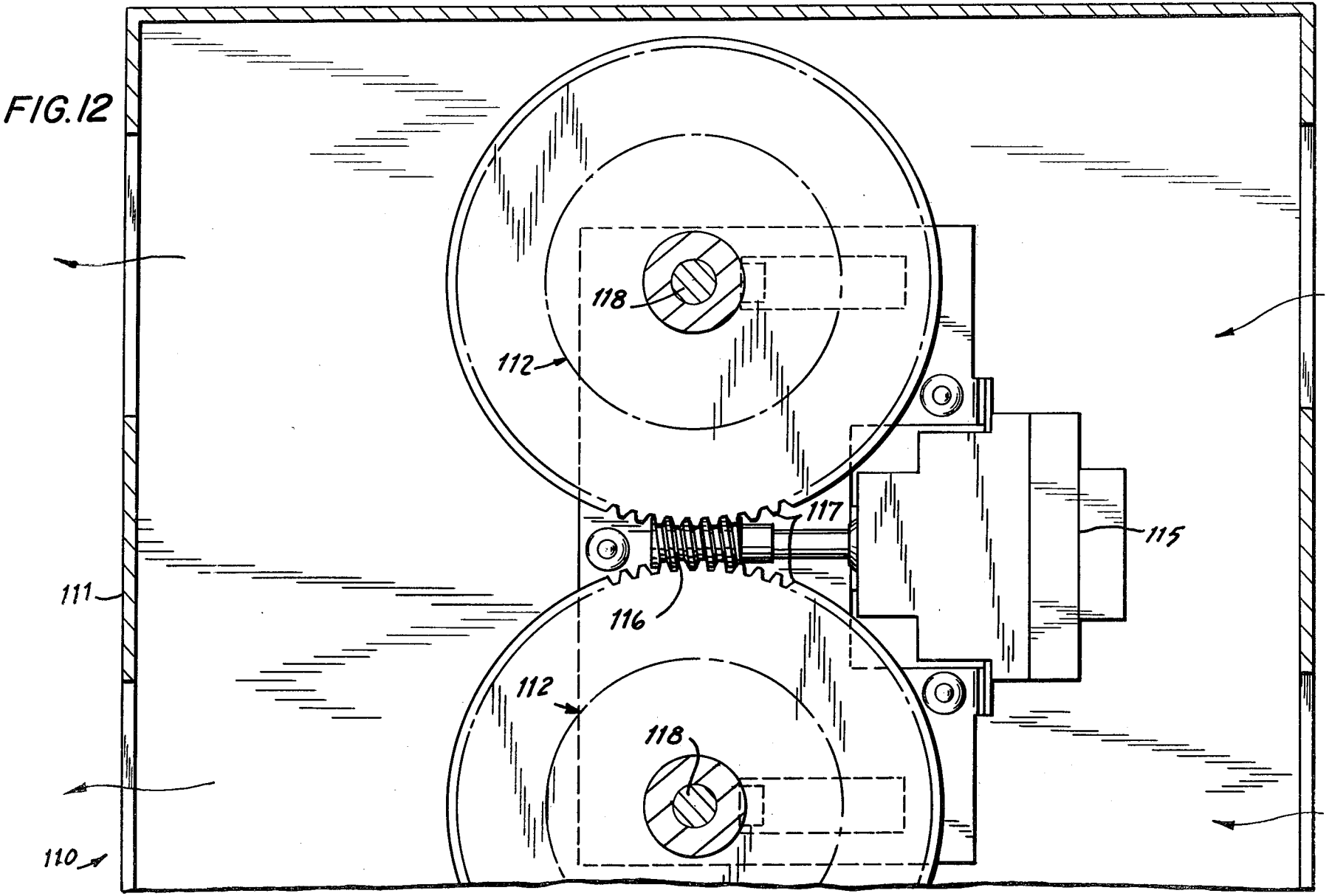
FIG. 12 is a top elevational view in cross-section of a dual head foot massager without the massage heads, showing the worm gear drive.

Depicted in FIGS. 11, 12 and 13 is a dual head foot massager device 110 of this invention. Although it is not depicted with a vibrator, one can be attached as shown in FIG. 14, if desired.

The following is a description of the dual head massager, however, it is equally applicable to the single head foot massager depicted in FIG. 14 since each has the same structures but the single head foot massager has only one orifice 112, one massage head 114, one gear 117, one driver with a socket hole 119 and one driver guide shaft 118.

As depicted, the housing 111 has two orifices 112 which are spaced apart to enable one to place one foot on each of the massage heads 114 placed therein. The height of the heads is such that the feet rest on the surface of the housing and the heads comfortably. The pressure of the feet on the massage heads 114 helps prevent the heads from rotating when the motor 115 is turned on with switch 122. When the motor 115 is turned on, it actuates worm gear 116 which turns gears 117 each of which in turn rotate drivers with socket holes 119. The drivers with socket holes 119 are fixed to the gears 117 which are mounted to rotate freely on the driver guide shaft 118. The socket holes are on the upper ends of the drivers 119 and are tilted at an angle wherein the axes of the drivers 119 and the driver guide shafts 118 which are concentric intersect the axes of the massage heads 114 at half the height of the center posts 14. This causes the edges 120 of the heads to nutate (wobble), resulting in the desired non-rotating kneading, massaging action on the feet. The angle of the axis can be varied to alter the desired angle of wobble to provide more shear, however, an angle of about 13°–15° which results in an angle of wobble of about 26°–30° is preferred. The motor 115 and gears 117 are selected to enable them to rotate the drivers with the socket holes 119 at about 60–70 RPM. This rotation rate is in approximate synchronization with the heartbeat. Other conventional means may also be used to rotate the drivers with the socket holes, directly or indirectly, e.g., belts, gears, and the like.

The massage heads 114 also can be prevented from rotating substantially with the drivers with the socket holes 119 by several conventional expedients. For example, as shown in FIGS. 11 and 14, the massage heads 114 can have collars 123 which frictionally abut felt wipers 121 at one side of the orifices 112. The collars 123 are designed to have sufficient downward length so the bottom edge is inside the orifices 112 and below the top edge of the orifices 112, this prevents pinching of the foot between the massage head 114 as it undulates and the housing 111. this is the preferred configuration of the massage heads. Another structural expedient is shown in FIGS. 1, 2, 4, 6, 8 and 9 wherein a key 15 extends downward from the base of the massage head with or without a collar to engage a keyhole or slot 16 in the surface of the housing.

If it is desired to have the foot massaging device vibrate, an unbalanced weight can be attached to the drive shaft of worm gear 116 or an electromagnetic vibrator motor can be attached to the inside of the top of the housing 111 as shown in FIG. 14. In FIG. 14, an electromagnetic vibrator 131 is rigidly affixed with screws through its armature 142 to bosses 143 on the inner face of the top of the housing 111. Any conventional electromagnetic vibrator can be used, however, it is preferred to use a relatively small lightweight vibrator so it can be adapted to portable massagers.

The depicted electromagnetic vibrator 131 is comprised of a circular relatively flat assembly having a coil 137 wound around a plastic bobbin 139 having a steel core 138 which in addition to being magnetic, is used to rivet the bobbin 139 to one leg 140 of an integral U-shaped plate comprised of the one leg 140 to which the bobbin 139 is riveted and an armature 142. The portion of the U-shaped plate connecting the leg 140 and the armature 142 is a spring 141. The vibrator 131 is electrically connected to a power source (not shown) by wires 144, through a four position, two pole switch (not shown). The vibrator 131 can be activated simultaneously with the massage motor 115 or each can be activated separately, depending on the user's wishes.

What is claimed is:

1. A massage head mechanism comprising a massage head of generally short conical shape having a post fixedly attached essentially perpendicularly to the base of the head, a rotatable driver, a socket fixedly attached to said driver at an angle thereto and rotatable therewith, wherein said post is rotatably fitted into said socket and said post has an outside diameter smaller than the inside diameter of said socket to permit rotational slippage therebetween, resisting means cooperating with said massage head to enable the massage head to nutate without rotating when said driver is rotating.

2. The massage head mechanism of claim 1 wherein said massage head is removable while the rotatable driver is rotating.

3. The massage head mechanism of claim 1 wherein the driver rotates from about 60 RPM to about 70 RPM.

4. The massage head mechanism of claim 1 wherein said massage head has concentric rings on the top surface thereof.

5. The massage head mechanism of claim 1 wherein said massage head has hemispherical tip pins on the top surface thereof.

6. The massage head mechanism of claim 1 wherein said massage head has radial bars on the top surface thereof.

7. The massage head mechanism of claim 1 wherein the socket and the driver are integral.

8. The massage head mechanism of claim 1 wherein said resisting means comprises a keying pin extending downwardly from the base of said massage head.

9. The massage head mechanism of claim 1 wherein said massager head has a circular collar extending downward from the outer periphery of the base thereof.

10. A massaging device comprising, in combination:

(a) a housing having an orifice in one surface thereof, said housing containing fixedly attached therein a rotatable driver operatively connected to a motor for rotation at a pre-determined rate;

(b) a socket fixedly attached to said driver at an angle thereto and rotatable therewith;

(c) a massaging head of generally short, conical shape in rotatable operative engagement with said angled socket by means of a post fixedly attached essentially perpendicularly to the base of the massaging head, said post having an outside diameter smaller than the inside diameter of said socket to permit rotational slippage therebetween;

wherein the angle between said driver and said socket is such that the axis of the driver intersects the axis of said conical massaging head at the apex of the cone;

(d) resisting means cooperating with said massaging head to enable the massaging head to nutate without rotating when said driver is rotating; and (e) means for transmitting power to said motor to rotate said driver and cause said massage head to nutate in a non-rotating kneading, massaging motion when said driver is rotating.

11. The massaging device of claim 10 wherein said housing is of a shape and size suitable for holding in the hand.

12. The massaging device of claim 10 wherein said resisting means comprises an external body brought into contact with said massaging head to permit the desired non-rotating kneading, massaging motion of said massaging head.

* * * * *